United States Patent [19]

Barlean

[11] Patent Number: 5,020,666

[45] Date of Patent: Jun. 4, 1991

[54] HOLDER FOR OPEN END WRENCHES

[76] Inventor: Bernard T. Barlean, 504 E. Main, Everson, Wash. 98247

[21] Appl. No.: 488,727

[22] Filed: Mar. 2, 1990

[51] Int. Cl.[5] ..... B65D 85/20; A47F 7/00

[52] U.S. Cl. ..... 206/376; 206/372; 211/7; 211/70.6

[58] Field of Search ..... 206/376, 375, 372, 493; 211/70.6, 7, 60.1; 248/316.1; 294/159, 162, 163

[56] References Cited

U.S. PATENT DOCUMENTS

| | | | |
|---|---|---|---|
| 1,750,011 | 3/1930 | Kneier | 206/375 |
| 1,809,450 | 6/1931 | Platt | 206/376 |
| 1,914,276 | 6/1933 | Moore | 211/4 |
| 1,967,458 | 7/1934 | Vallone | 206/376 |
| 2,119,217 | 5/1931 | Rocchi | 206/376 |
| 2,465,290 | 3/1949 | Sorenson | 206/376 |
| 4,690,367 | 9/1987 | Weathers | 206/372 X |
| 4,911,297 | 3/1990 | Suburu | 206/376 |

FOREIGN PATENT DOCUMENTS

| | | | |
|---|---|---|---|
| 955218 | 12/1956 | Fed. Rep. of Germany | 206/376 |
| 675710 | 11/1929 | France | 206/376 |
| 714273 | 11/1931 | France | 206/376 |

*Primary Examiner*—Bryon P. Gehman

*Attorney, Agent, or Firm*—Hughes & Multer

[57] ABSTRACT

Holders for wrenches which have an open end. Vertically extending spacers and a transversely extending pin cooperate to retain vertically hung wrenches in the holder. A releasable latch can be provided to keep the lower ends of stored wrenches within the bounds of the tool holder. This keeps tools from falling out of the holder if it is roughly handled, dropped, turned upside down, etc. Devices for attaching the holder to a support may also be provided. This keeps the tool holder handy in many instances, facilitating access to stored materials. Attaching the holder to a support will also keep it out of mud, spilled lubricants, and other muck.

5 Claims, 4 Drawing Sheets

HOLDER FOR OPEN END WRENCHES

The present invention relates to novel, improved holders for wrenches which have an open end.

BACKGROUND OF THE INVENTION

Wrenches of the type with which the present invention is concerned are typically made available in sets with each wrench in the set being designed to fit a nut, bolt head, etc. of different size. It is common for such wrenches to be indiscriminately stored in a toolbox or chest, making it onerous and time consuming to retrieve a wanted tool.

As a consequence, a number of holders for such tools have been proposed. These are so designed that a set of wrenches can be stored in order; i e., ranked by size. This makes it much easier to select the tool needed for a particular task. Also, such a holder makes it easier to carry a set of wrenches from one place to another in circumstances in which a box full of tools is not required. At the same time, this carrying of a full set of wrenches avoids the possibility of the user not having the correct tool if he selects only one or two for the task at hand.

Tool holders of the character just discussed are disclosed in U.S. Pat. Nos.: 2,068,308 issued Jan. 19, 1937 to Zerver for HOLDER OF TOOLS; U.S. Pat. No. 3,370,696 issued Feb. 27, 1968 to Groe for WRENCH CARRIER; U.S. Pat. No. 3,702,136 issued Nov. 7, 1972 to Albertson for WRENCH HOLDER; and U.S. Pat. No. 4,269,311 issued May 26, 1981 to Rich for PORTABLE HAND CARRIED KIT FOR A SET OF WRENCHES AND THE LIKE and in British patent specification No. 2160763 entitled SPANNER HOLDER and published Aug. 26, 1987.

Heretofore proposed tool holders of the type with which I am concerned tend to be complicated. Also, they are typically designed to accommodate one particular set of tools, which limits their utility. Provision for securing of the tools in the holder so that they will not fall out if the holder is dropped, turned upside down, etc. is another typical deficiency of the prior art tool holders.

SUMMARY OF THE INVENTION

I have now invented, and disclosed herein, certain new and novel tool holders which are: (a) designed to store in ranked size tools of the type having at least one open end, and (b) free of the drawbacks and disadvantages which previously proposed tools of this type have.

Briefly, tools of the type disclosed herein have a series of tool rests arrayed in side-by-side relationship and a pin above and spanning the array of tool rests. The pin traps the head of a wrench stored in the holder and hanging vertically against its associated rest, keeping the tool from moving downwardly and falling out of the holder. The pin also engages the tool at the inner end of its jaws, keeping the tool from moving upwardly.

Partitions between the spacerlike tool rests keep the tools from shifting to side-to-side and falling out of the tool holder.

A releasable keeper or latch may be provided at the lower end of the holder. This component keeps the tools from swinging away from the tool rests and falling out of the holder if the holder is tilted, turned upside down, roughly handled, dropped, etc.

A spring clip, magnet, or other device can be attached to the back of the tool holder This allows the tool holder to be hung up or otherwise removably attached to a support, facilitating access to the tools stored in the holder.

The novel tools of the character just described are simple, which makes it possible to supply them at a reasonable price.

Simply by employing spacers of different widths, these holders can be configured to accommodate tool sets with wrenches of different widths. The ability to make this accommodation is also probably essential as it would undoubtedly be impractical to provide a different holder for each of the many different sets of open end wrenches.

The releasable keeper ensures that the tools are securely locked in the holder when they are not being used, irrespective of the orientation of the holder or the manner in which it is handled. At the same time, releasing the keeper gives instant access to the stored tools.

And, as was just discussed, the novel tool holders disclosed herein have the advantage that they can be hung up or otherwise attached to a supporting surface, thereby making it easier to reach tools stored in the holder and to keep the tools clean.

OBJECTS OF THE INVENTION

From the foregoing, it will be apparent to the reader that one important and primary object of the present invention resides in the provision of novel, improved holders for wrenches having an open end.

Other also important but more specific objects of the present invention reside in the provision of tool holders as described in the preceding object:

- which are simple and can therefore be provided at reasonable cost;
- which can readily be configured to accommodate wrenches of different sizes;
- which positively secure stored tools in place, yet make them instantly available to a user; and
- which can be hung up or otherwise attached to a supporting surface, thereby making the stored tools easier to reach and easier to keep clean.

Other important objects and features and additional advantages of the invention will be apparent to the reader from the foregoing and the appended claims and as the ensuing detailed description and discussion proceeds in conjunction with the accompanying drawing.

DETAILED DESCRIPTION OF THE INVENTION

Figure 1:
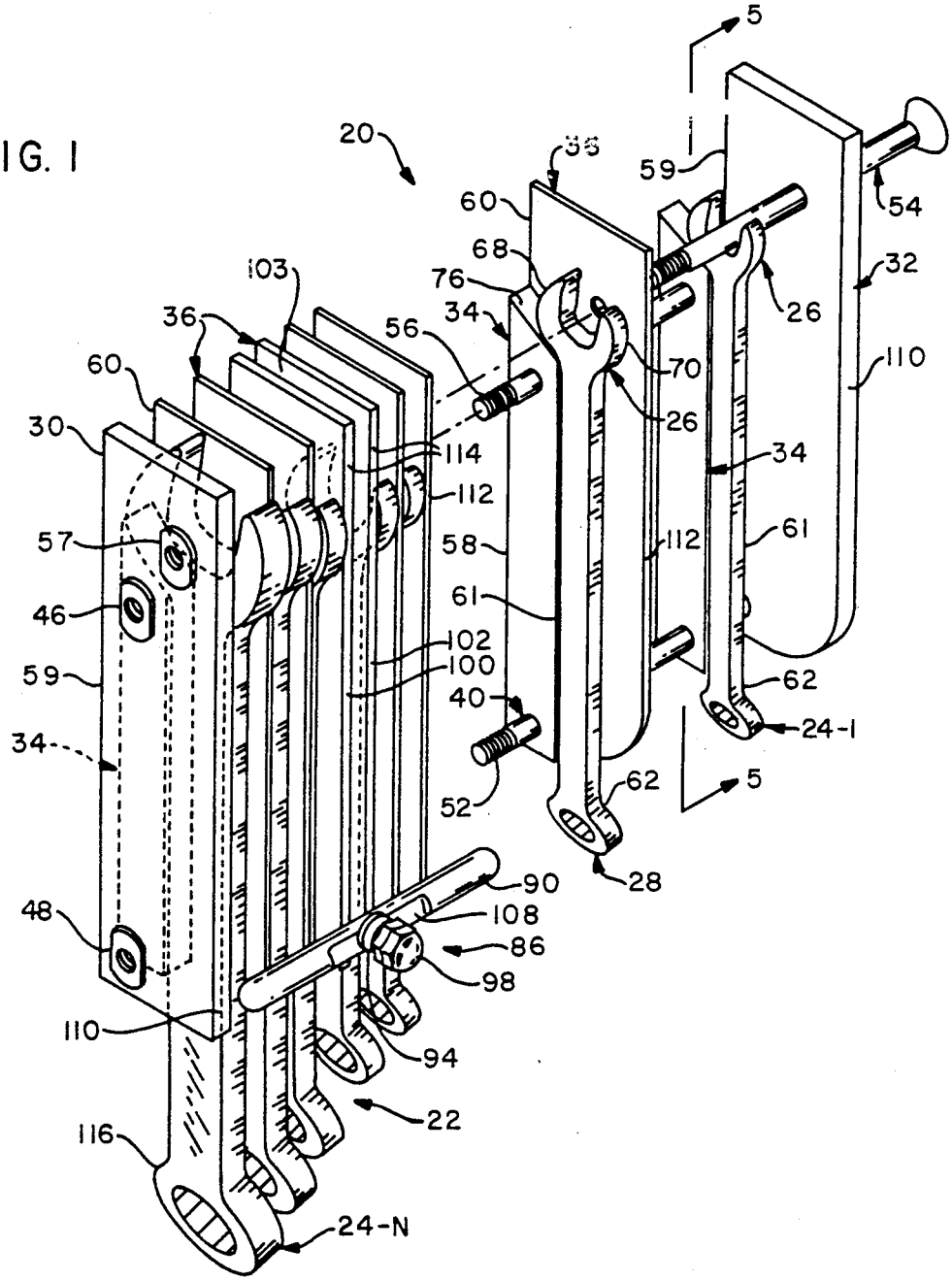
FIG. 1 is an exploded view of a tool holder embodying the principles of the present invention.

In the ensuing detailed description of the invention and the appended claims, a number of direction-related terms such as vertical, top, bottom, above, etc. will be employed. These terms are related to the orientation of the exemplary tool holders illustrated in the drawing, are being employed in the interest of brevity and clarity, and are not intended to limit the scope of the appended claims.

Referring now to the drawing, FIGS. 1–5 depict a tool holder 20 constructed in accord with, and embodying, the principles of the present invention. This particular tool holder is designed to store a set 22 of wrenches 24-1–24-n. The illustrated wrenches 24 are of a common type having one open end head 26 and one box end 28. Tool holder 20 can equally well be employed to store tools which instead have both ends open.

Figure 2:
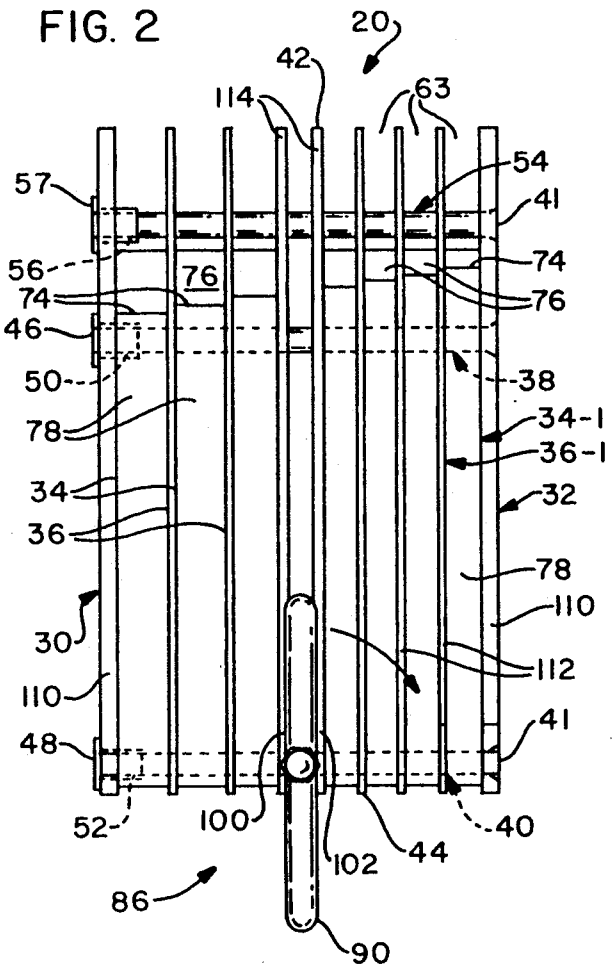
FIG. 2 is a front view of the tool holder.

As is best shown in FIGS. 1 and 2, tool holder 20 includes vertically extending side wall components 30 and 32 with a series of elongated, spacerlike, tool rests 34 assembled therebetween and separated by elongated, thin, vertically extending partitions 36. This array of side wall members, tool rests, and partitions is held in the assembled relationship shown in FIG. 2 by a pair of transversely extending fasteners 38 and 40 with flush countersunk heads 41. Fasteners 38 and 40 are respectively located toward the top 42 and bottom 44 of holder 20. They are secured in place by flush-mounted, internally threaded retainers 46 and 48 into which the exposed ends 50 and 52 of fasteners 38 and 40 are threaded. Thus, with the retainers 46 and 48 threaded on fasteners 38 and 40, tool rests 34, partitions 36, and side plates 30 and 32 are assembled into a rigid, integral unit.

Figure 3:
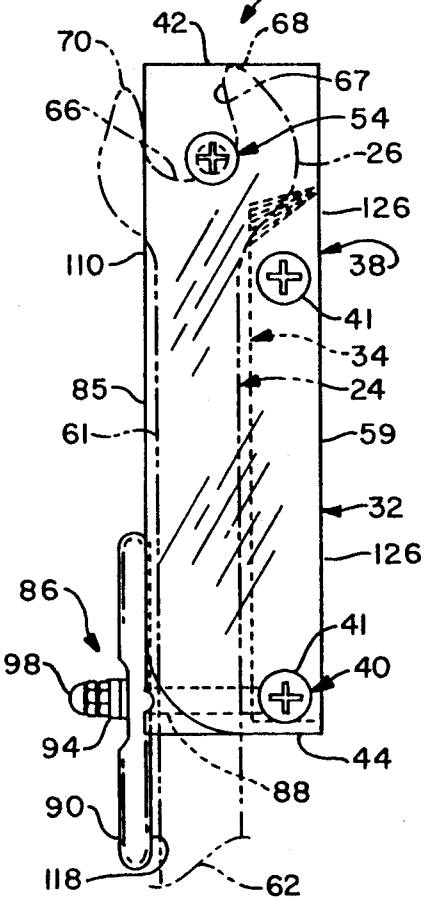
FIG. 3 is a right-hand end view of the tool holder.

Referring now most particularly to FIGS. 1–3, another major component of tool holder 20 is a transversely extending, wrench retaining pin 54. This pin spans tool holder 20 and, as is best shown in FIGS. 2 and 3, is located above and slightly in front of the several tool rests 34 of the tool holder. Wrench-retaining pin 54 is held in place by threading its threaded, free end 56 into a third, flush-mounted, internally threaded fastener 57.

The spacerlike tool rests 34 are dimensioned so that they extend from adjacent the bottom 44 of tool holder 20 upwardly past fastener 38 to the above-discussed locations beneath retaining pin 54 in which they cooperate with the latter to retain wrenches 24 in the tool holder. This also allows the tool rests to be connected up with the associated tool holder components by both the lower fastener 40 and the upper fastener 38. The rear edges 58 of the tool rests 34 coincide generally with the rear edges 59 of side plates 30 and 32 and the rear edges 60 of partitions 36 but are considerably narrower than the side plates and partitions as is apparent from FIG. 5 for example. This allows the shanks 61 of even the largest wrenches 24 that tool holder 20 is designed to accommodate to fit well within the confines of the tool holder. This is important both in ensuring the proper cooperation among the tool rests 34, the heads 26 of the installed tools, and the tool-retaining pin 54 and in accommodating the tool-retaining latch or keeper discussed briefly above and in more detail hereinafter.

Figure 5:
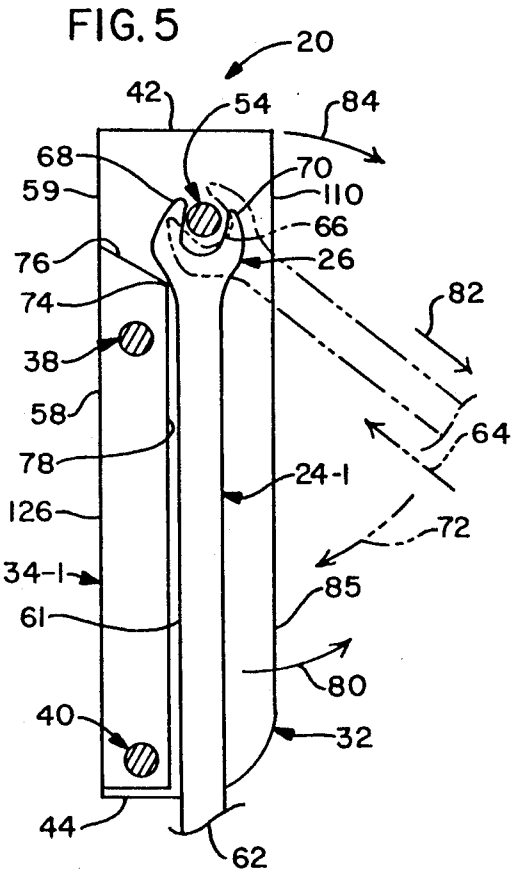
FIG. 5 is a vertical section through the tool holder, looking the direction of arrows 5—5 in FIG. 1 and showing the technique for storing a tool in and removing it from the holder.

Referring now to FIG. 5, a wrench—in this case wrench 24-1—is stored in tool holder 20 by orienting the tool as shown in phantom lines in FIG. 5: (1) in front of tool holder 20, and (2) in alignment with the space or slot 63 between the right-hand side plate 32 of the tool holder and the right-hand most partition 36-1. Next, the tool is displaced in the direction indicated by arrow 64 until the end 66 of the gap 67 between the two jaws 68 and 70 at the head 26 of wrench 24-1 engages wrench-retaining pin 54. Then, the wrench is rotated about pin 54 in the direction indicated by arrow 72 until it reaches the vertical position shown in solid lines in FIG. 5. At this point, and as is shown in the same Figure, the head 26 of the tool will engage and rest on the sharp, transversely extending edge 74 between the forwardly and downwardly inclined upper surface 76 of tool rest 34-1 and the vertical front surface 78 of that spacer, the tool being retained in this position by gravity. The head 26 of tool 24-1 cannot slip off tool rest 34-1 because, if it moved forward, this would be prevented by jaw 68 of the tool engaging tool retainer pin 54 well before the wrench head 26 could clear the tool rest Tool 24-1 is removed from tool holder 20 by reversing the process just described; i.e., rotating the tool in the direction indicated by arrow 80 in FIG. 5 and then sliding the tool out of slot 63 as indicated by arrow 82.

The other of the tools 24-2–24-n shown in FIG. 1 are installed in tool holder 20 and subsequently removed from that holder in the manner just described in conjunction with tool 24-1.

In this regard, and as is shown in FIG. 2, the several tool rests 34-1–34-n of tool holder 20 differ in length and thickness. In each set 22 of wrenches of the type with which tool holder 20 is designed to be employed, the wrenches 24 will range from those which are relatively thin and have relatively small heads (wrench 24-1 in FIG. 1) to those which are much thicker and have much larger heads (wrench 24-n). These differences are accommodated in a unique and elegant fashion in tool holder 20 by simply making each successive tool rest 34 wider and shorter than the preceding one.

Similarly, by substituting a set of tool rests with different lengths and thicknesses, tool holder 20 may be readily reconfigured to accommodate a different set of open end wrenches. Such tool rests may be supplied with the tool holder or separately.

Aside from those above-discussed dimensions of tool rests 34, the dimensions of tool holder 20 are not critical except that its length from top to bottom must be short enough that the lower end 62 of the shortest tool 24 to be stored in it can protrude below the bottom 44 of the tool holder. This allows the user to grasp the lower end 62 of a stored tool and remove it from tool holder 20 in the manner described above.

It will be apparent from the foregoing and FIG. 5 that, if tool holder 20 were tilted in the direction indicated by arrow 84 in that Figure or laid down on its front side 85 and subsequently picked up in that orientation, the tool or tools 24 stored in the tool holder might swing in the direction indicated by arrow 80 in FIG. 5 and then fall out of the tool holder. This is prevented, without denying instant access to tools 24, by the latch mechanism 86 shown in FIGS. 1–4. This mechanism includes a studlike latch support 88, a latch element 90, a washer 92, a compressible ring 94, a nut 96, and a cap nut 98.

Threaded support 88 is located between and bonded to elongated, vertically oriented members 100 and 102. These are somewhat thicker than but otherwise of the same configuration as partitions 36 and are located with a space 103 therebetween midway between tool holder side plates 32 and 34.

One threaded end 104 of the support or stud 88 extends forwardly beyond the front side 85 of tool holder 20. There, stud 88 extends through a centrally located hole 106 in latch element 90, this aperture being of a large enough diameter that the latch element can freely rotate on supporting stud 88 after it is assembled on that stud. Next to be assembled on stud 88 is washer 92, which is seated on a flat 108 formed on latch element 90. Washer 92 is followed by compressible ring 94, nut 96, and cap nut 98. Nut 96 clamps compressible ring 94 against latch element 90 and the latter against the front edges 110 of tool holder side plates 30 and 32, the front edges 112 of partitions 36, and the front edges 114 of stud-supporting members 100 and 102. Cap nut 98 protects the user from rough or sharp edges at the free end 104 of stud 88 and gives tool holder 20 a more finished appearance.

With latch element 90 rotated to the horizontal position shown in FIG. 1, that element spans the several slots 63 in which tools 24 can be stored at a location adjacent the bottom 44 of tool holder 20.

This keeps the lower ends 62 of stored tools 24 from swinging out of the holder (see arrow 80 in FIG. 5). As a consequence, stored tools cannot slip off their tool rests 36 and fall out of the holder even if tool holder 20 is roughly handled, dropped, or turned upside down.

Figure 4:
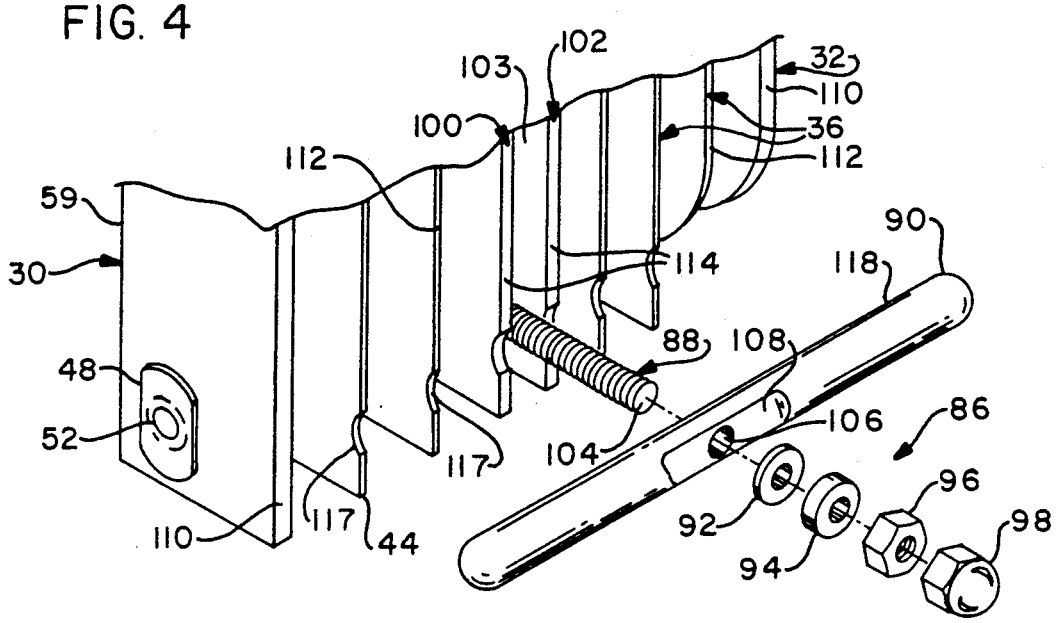
FIG. 4 is a perspective view of the lower end of the tool holder, provided to show the details of a keeper for positively securing tools in the holder.

As is best shown in FIG. 4, transversely aligned, equally dimensioned arcuate notches 117 are formed in the front edges 112 of partitions 36 and in the front edges 114 of latch stud-supporting members 100 and 102. Compressible ring 94 biases the rear side 118 of the similarly dimensioned latch element 90 into these recesses when the latch element is rotated to its closed, FIG. 1 orientation. This ensures that latch element 90 will remain in its closed, wrench-retaining orientation during handling of tool holder 20, if the tool holder is dropped, turned upside down, etc.

To access a tool 24 in tool holder 20, latch element 90 is rotated to the vertical position shown in FIGS. 2 and 3. There, it lies opposite the gap 103 between the latch mechanism stud-supporting members 100 and 102. This is easily effected because of the yieldability of ring 94.

As is readily apparent from FIG. 2, this rotating of latch element 90 to the vertical position allows tools 24 to be stored in all of the slots 63 in tool holder 20 and removed from the tool holder in the manner discussed above.

Figure 6:
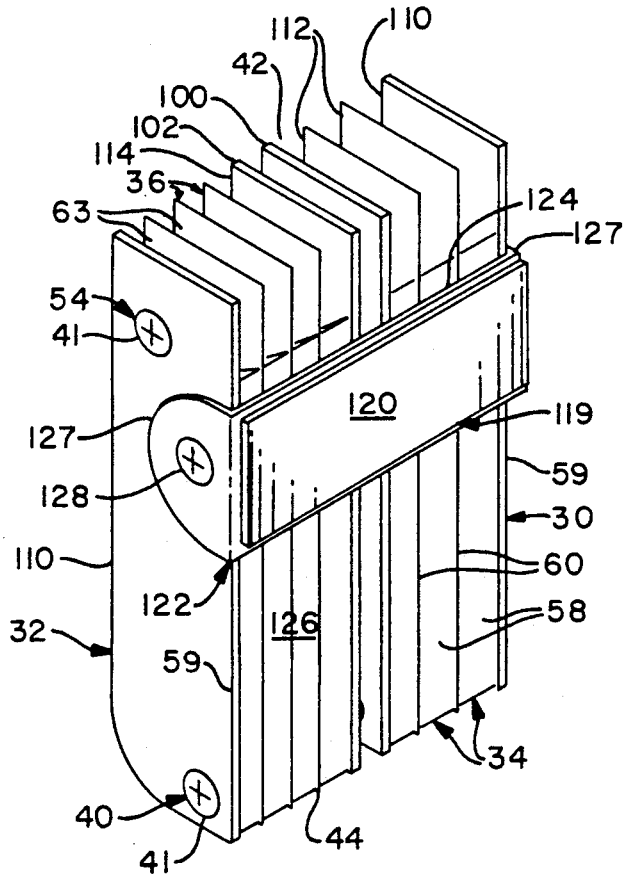
FIG. 6 is a perspective view of the tool holder, showing a bar magnet for affixing the holder to a supporting surface.

It will be apparent to those skilled in the arts to which this specification is addressed that there are many instances in which access to a wrench 24 stored in tool holder 20 can be facilitated by keeping the tool holder close at hand. A magnetic device or holder for accomplishing this objective is illustrated in FIG. 6 and identified by reference character 119. Magnetic holder 119 includes a magnet 120 bonded to a U-shaped support 122. The main section 124 of the support spans, and is butted against, the back side 126 of tool holder 20. The ends 127 of support 122 fit against the side plates 30 and 32 of the tool holder and are fixed to it as by countersunk Phillips screws 128 (only one of which is shown). Magnetic keeper 119 allows tool holder 20 to be detachably affixed to virtually any horizontal, vertical, or inclined surface to which magnet 120 can be attracted.

Figure 7:
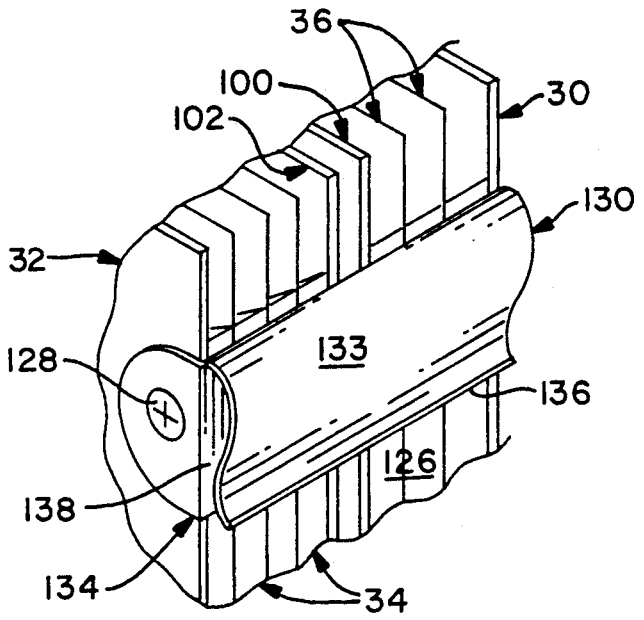
FIGS. 7 and 8 are fragments of a view similar to FIG. 6 but showing two other schemes for attaching the tool holder to a support.
Figure 8:
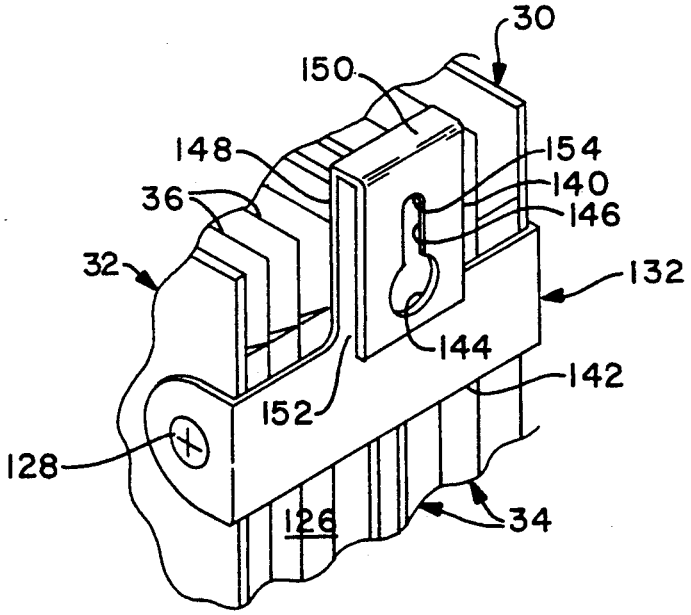

Alternatives to the magnet-type keeper 119 just described are those of the spring clip type (130 in FIG. 7) and keyhole type (132 in FIG. 8).

The spring clip-type keeper 130 shown in FIG. 7 includes a spring clip element 133 and an integral support bracket element 134. Bracket element 134 may be identical to the bracket 122 described above and can be attached to tool holder 20 in the same manner; i.e., by countersunk Phillips head screws 128.

The spring clip element 133 is of conventional configuration and operates in an equally conventional manner. That is, the outwardly curved lower edge 136 of this element allows the tool holder to be slid down over the upper edge of an appropriate support (not shown) such as a vertically oriented metal plate, the lower edge 136 of clip element 133 moving away from the main body section 138 of support element 134 as this occurs. Thereafter, clip element 133 will restore toward its bias-free position, clamping the supporting structure between the clip and support elements 133 and 134 of keeper device 130 and securely fastening tool holder 20 to the supporting structure.

Tool holder 20 is equally easy to remove from the supporting structure. This is accomplished simply by moving it upward and off of that structure.

The keyhole-type keeper 132 shown in FIG. 8 allows tool holder 20 to be hung from a fastener such as a nail. It has a keyhole element 140 for attaching the device to the nail (or similar device) and an integral, U-shaped bracket element 142, also of the character discussed above in conjunction with FIGS. 6 and 7.

The keyhole device 132 for hanging up tool holder 20 is, like those discussed above, attached to the tool holder 20 as by countersunk Phillips head screws 128.

Element 140 of the device has a conventional keyhole with a circular aperture 144 and a communicating, vertically extending slot 146 of a lesser width.

Element 140 is supported from a vertically extending, integral section 148 of device 132 by an also integral, horizontally and rearwardly extending section 150 of the device. This spaces the sections 140 and 148 of the device apart, providing a gap 152 which accommodates the head of the nail or other element on which tool holder 20 is hung.

The tool holder hanging device 132 illustrated in FIG. 8 is employed like other devices of that character. That is, tool holder 20 is positioned with the enlarged, circular aperture 144 opposite the head of the nail or the like on which the tool holder is to be hung. The tool holder is then moved toward the supporting element until the head of that element clears keyhole section 140 of the device. The tool holder is then lowered until the supporting element passes into vertical slot 146 and is seated against the upper end 154 of that slot, arresting the downward movement of the tool holder. Because of its reduced width, the edges of slot 146 can engage the head of the supporting element to keep tool holder 20 from sliding off of it.

The invention may be embodied in specific forms other than those disclosed above without departing from the spirit or essential characteristics of the invention. The present embodiment is therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. A tool holder for storing wrenches which have an elongated shank and first and second spaced apart jaws at one end of said shank, said tool holder being vertically orientable and, thus oriented, having an upper end, a lower end, a front, sides and a back, the tool holder in a vertical orientation comprising:

a series of tool rests disposed in side-by-side relationship, each of said tool rests extending from near the upper end to the lower end of the holder and having one edge at the back of the tool holder, an opposed second, stop-providing edge for the shank of a wrench stored in said holder, a lower end and a beveled upper end which provides a seat for a jaw of a wrench installed in the holder;

partitions sandwiching adjacent tool rests, a said partition and a side wall component sandwiching each of the outermost tool rests, said partitions and side wall components having portions lying beyond the second edges of the tool rests at the front of the tool so that said partitions are capable of embracing the shanks of wrenches stored in said tool holder and keeping said wrenches from shifting from side to side in said holder; and a pin extending from side to side through the tool holder, said pin being spaced above the beveled upper ends of said tool rests so as to engage wrench jaws seated on said tool rests and so trap said jaws on said rests as to keep wrenches stored in the tool holder from dropping out of said holder.

2. A tool holder as defined in claim 1 which has means on the back of the tool holder for detachably fixing the tool holder to a means for supporting the tool holder in a designated orientation at a specific location.

3. A tool holder as defined in claim 1 which has a releasable means at the lower end thereof which keeps a stored tool from swinging about said pin and thereby clearing the tool rest and falling out of the holder, said releasable means comprising:

a latch support extending from the front of the tool holder;

a latch mounted on said support for pivotable movement between: (a) a first position in which the latch so engages those edges of the partitions and side wall components at the front of the holder so as to span the gaps therebetween and keep stored wrenches from falling out of the holder, and (b) a second position in which said gaps are exposed and stored wrenches can accordingly be removed from the holder; and means which promotes the retention of the latch in said first position.

4. A tool holder as defined in claim 3 in which there are aligned recesses in said partitions and side wall components at the front of the holder in which the latch is seated in the first position thereof and the release means comprises a means for biasing said latch against said partitions and said side wall components so as to keep said latch seated in said recesses and said latch in said first position.

5. A tool holder as defined in claim 3 which has a fastener means toward the lower end of the tool holder for uniting the side wall components, and tool rests of the holder.

* * * * *